US007353943B2

(12) United States Patent
Evans et al.

(10) Patent No.: US 7,353,943 B2
(45) Date of Patent: Apr. 8, 2008

(54) POOL CUE CASE SYSTEMS

(76) Inventors: Kirk Boyd Evans, 1690 E. San Tan St., Chandler, AZ (US) 85225; Wayne Kirk Evans, 1766 E. Tara Dr., Chandler, AZ (US) 85225

( * ) Notice: Subject to any disclaimer, the term of this patent is extended or adjusted under 35 U.S.C. 154(b) by 330 days.

(21) Appl. No.: 11/073,154

(22) Filed: Mar. 5, 2005

(65) Prior Publication Data

US 2006/0196791 A1 Sep. 7, 2006

(51) Int. Cl.
*B65D 85/20* (2006.01)
*A63B 55/00* (2006.01)

(52) U.S. Cl. ..... 206/315.1; 206/315.7; 190/18 R; 190/102; 248/97; 248/171

(58) Field of Classification Search ..... 206/315.1, 206/315.7, 317; 248/95–97, 135, 136, 461, 248/171; 190/18 R, 102, 108, 110, 1, 15.1
See application file for complete search history.

(56) References Cited

U.S. PATENT DOCUMENTS

| | | | | | |
|---|---|---|---|---|---|
| 1,791,188 | A | | 2/1931 | Bright | |
| 1,811,296 | A | * | 6/1931 | Boden et al. | 248/96 |
| 1,924,182 | A | * | 8/1933 | Fritz | 248/96 |
| 1,954,413 | A | | 4/1934 | Hunter | |
| 1,982,388 | A | * | 11/1934 | Huehn | 248/96 |
| 2,282,842 | A | | 5/1942 | Abell | |
| 2,283,412 | A | | 5/1942 | Bright | |
| 3,195,844 | A | | 7/1965 | Roepke | |
| 4,087,068 | A | | 5/1978 | Gardner | |
| 4,226,389 | A | | 10/1980 | Neth | |
| 4,228,877 | A | * | 10/1980 | Cothary | 190/18 A |
| 4,647,056 | A | * | 3/1987 | Baker | 280/37 |
| 4,739,958 | A | | 4/1988 | Sato | |
| 4,761,012 | A | * | 8/1988 | Dames | 280/38 |
| 4,767,001 | A | * | 8/1988 | Kim | 206/315.3 |
| 4,898,352 | A | | 2/1990 | Hoffman | |
| 4,915,332 | A | | 4/1990 | Ouellette | |
| 4,979,598 | A | * | 12/1990 | Verheij et al. | 190/18 A |
| 5,082,218 | A | | 1/1992 | Hoffman | |
| 5,456,355 | A | * | 10/1995 | Usswald et al. | 206/315.7 |
| 5,472,084 | A | * | 12/1995 | Aliano, Jr. | 206/315.3 |
| 6,253,913 | B1 | | 7/2001 | Suk | |
| D465,325 | S | * | 11/2002 | Lin | D3/254 |
| 6,508,359 | B1 | * | 1/2003 | He et al. | 206/315.3 |
| 6,561,348 | B2 | * | 5/2003 | Kuo | 206/315.1 |
| D509,956 | S | * | 9/2005 | Lin | D3/254 |
| 2002/0043474 | A1 | * | 4/2002 | Hamamori | 206/315.3 |
| 2003/0111369 | A1 | * | 6/2003 | Markowitz, Jr. | 206/315.1 |
| 2004/0026199 | A1 | * | 2/2004 | Chen | 190/108 |
| 2005/0051982 | A1 | * | 3/2005 | Su | 280/47.26 |

* cited by examiner

*Primary Examiner*—Sue A. Weaver
(74) *Attorney, Agent, or Firm*—Keith L. Jenkins; Keith L. Jenkins, Registered Patent Attorney, LLC

(57) ABSTRACT

Pool cue case systems are disclosed which include at least one re-closable enclosure which is operable to be coupled, preferably releasably coupled, to the exterior of a pool cue case or the like, and which has an integral support coupling adapted to receive supports used for supporting the case in a nearly vertical position for use, for example, as a pool cue rack for assembled pool cues. Various re-closable enclosures are disclosed which enable convenient deployment of support legs while providing protection for the supports when stowed for transport.

20 Claims, 7 Drawing Sheets

POOL CUE CASE SYSTEMS

FIELD OF THE INVENTION

The present invention relates to a pool cue case system including a pool cue case for transporting pool cue sticks that is reconfigurable as a stand for pool cue sticks, and more particularly to a pool cue case system having at least one stowable support in an optionally detachable external re-closable enclosure.

BACKGROUND OF THE INVENTION

Pool cue sticks are used for shooting pool and in related billiard games. A pool cue stick having two-piece construction typically has a coupling between the pool cue shaft and the handle portion that may be connected or disconnected by hand. Two-piece cue sticks may be transported in a pool cue case when disassembled. Pool cue cases for two-piece cues are generally cylindrical tubes, of various cross-sectional shapes, that are slightly longer than the shaft and handle of a disassembled pool cue stick. A pool cue case may have an insert, such as polyurethane foam insert, that substantially fills the interior of the case except for tapered bores in the insert adapted to receive disassembled cue sticks. Commercially available pool cue cases may have a handle, carrying strap, and/or one or more zippered pouches attached to the exterior of the pool cue case with straps. Zippered pouches may be used for carrying such essentials as chalk, spare tips spare ferrules, and similar game-related supplies and paraphernalia, for example.

When a pool player transports his cue sticks in a pool cue case to a tournament, he encounters at least two problems, as recognized by the present inventors. First, once the pool cue sticks are removed from the pool cue case and assembled, there is often no place to safely and securely place the pool cue sticks while not in actual use. A player may have different cues for different purposes. For example, he may have a break cue, a jump cue, and a shooting cue. Accordingly, a shooter may need a safe and secure place for two of his cues, even while shooting with one cue. At tournaments, it is common for wall racks for pool cue sticks to be inadequate for the crowd, and pool cue sticks can end up propped up against a wall or laid on the floor. Some pool cue sticks cost thousands of dollars, and such precarious temporary storage in crowded tournament rooms risks serious damage to the pool cue stick.

Second, there is no provision for storing the pool cue cases at many tournaments. As a result, the cases are often left on chairs, countertops, floors, tables, and other inconvenient places, adding annoyance to an already crowded room. The cases need to be kept in general proximity to the players for access to the contents thereof and for security. Players may move 50 feet or more between games and so may have to retrieve their cases after each game and carry their assembled cue sticks and their cases to the next game. This is cumbersome with current technology. In tournament play, shooters often have to wait a substantial amount of time between games. During this waiting time, the shooter wants to have a way to protect the cue sticks neatly out of the way while avoiding having to keep them in hand or having the cue sticks precariously laying about the tournament room.

Some attempts to partially solve each one of these problems have been made without great commercial success. For example, U.S. Pat. No. 4,898,352 (expired) to Hoffman disclosed a container stand, which could be a pool stick case, with deployable support legs attached to the exterior of the case to support the case in a nearly upright position. The legs could be attached directly to the case or to a strap that could then be secured to the case. The legs and bracket were exposed on the outside of the case, creating a risk of damage to the legs and to other luggage. In U.S. Pat. No. 5,082,218 (expired), Hoffman further disclosed retaining means for holding the legs adjacent to the case when not in use supporting the case. In U.S. Pat. No. 4,915,332 (expired) to Ouelette disclosed a portable Pool Cue Holder with deployable legs internally stowable in the cylindrical holder. Ouelette's holder appears vertical with a tripod stand that provides a significant increase in the footprint of the device when in use. Ouelette's holder discloses a preference that the holder be small, having a preferred height of 5¼ inches and a cylinder diameter of 1⅝ inches, holding one pool cue while the pool cue is not in use.

The present inventors have identified and isolated the problems: what is lacking are apparatuses (together comprising a pool cue case system) which enable pool cues and pool cue cases to be kept both neatly out of the way (such as near a table in a waiting area) and readily at hand during tournament play. Another problem identified by the present inventors is for a pool cue case for two-piece pool cues to be used as an assembled pool cue stand with reduced risk of damage to the support legs and to adjacent luggage during transport. The present inventors also identified the need for a pool cue case that may act as a pool cue stand for a plurality of assembled pool cues, and that is big enough to be seen in a crowded room and that has a reduced foot print on the floor.

Accordingly, what is needed is a pool cue case system with supports that enable the pool cue case to be supported in a nearly upright position on a floor. A further need is that the supports are stowable for transport, if not within the case, then within a re-closable enclosure, such as a zippered pouch, removably attached to the exterior of the main case tube. A further need is that the supports can be releasably coupled to the case by being coupled to a re-closable enclosure releasably attached to the exterior of the main case tube. Another need is for supports to be coupled to an interior surface of a re-closable enclosure releasably attached to the exterior of the main case tube and for the floor-engaging ends of the supports to be deployable out of the re-closable enclosure. A further need is for the option to have the supports constantly coupled to the re-closable enclosure. A further need is for the supports to be extendable. Yet a further need is for the deployment of the legs to not increase the footprint of the pool cue case on the floor. Yet another need is for the pool cue case system to accommodate a plurality of assembled pool cues, so that an unused cue will normally be in the nearly upright pool cue case. Yet another need is for a re-closable enclosure having deployable supports. Yet another need is for the re-closable enclosure to be operable to be coupled to a pool cue case. To meet the above-mentioned needs and to solve the above-mentioned problems, applicants present what follows.

BRIEF SUMMARY OF THE INVENTION

One embodiment of the present invention provides a case with a re-closable enclosure operable to be releasably coupled to the exterior of the case, a support for the case that is internally stowable within the re-closable enclosure, and a support coupling coupled to the re-closable enclosure. Another embodiment provides a pool cue case having a pool cue case reconfigurer operable to enable the pool cue case to support, in an inclined position, assembled disconnected sections of a pool cue, and a re-closable enclosure, operable to be releasably coupled externally to the pool cue case and operable to enclose at least part of the pool cue case reconfigurer in a stowed position. Another embodiment of the present invention provides a re-closable enclosure further having a support coupling coupled to at least a portion of the re-closable enclosure, a support having a proximal end operable to be coupled to the support coupling and a distal end at least partially deployable outside the re-closable enclosure, and at least one adaptation for enabling releasable coupling of the re-closable enclosure with a case to be supported. Additional embodiments provide various instantiations of design for the re-closable enclosure, supports, support coupling, and adaptations for coupling the re-closable enclosure to the case, including couplings that are part of the re-closable enclosure.

BRIEF DESCRIPTION OF THE DRAWINGS

The above and other objects and advantages of the present invention will become more apparent from the following description taken in conjunction with the following drawings in which.

DETAILED DESCRIPTION OF THE DRAWINGS

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
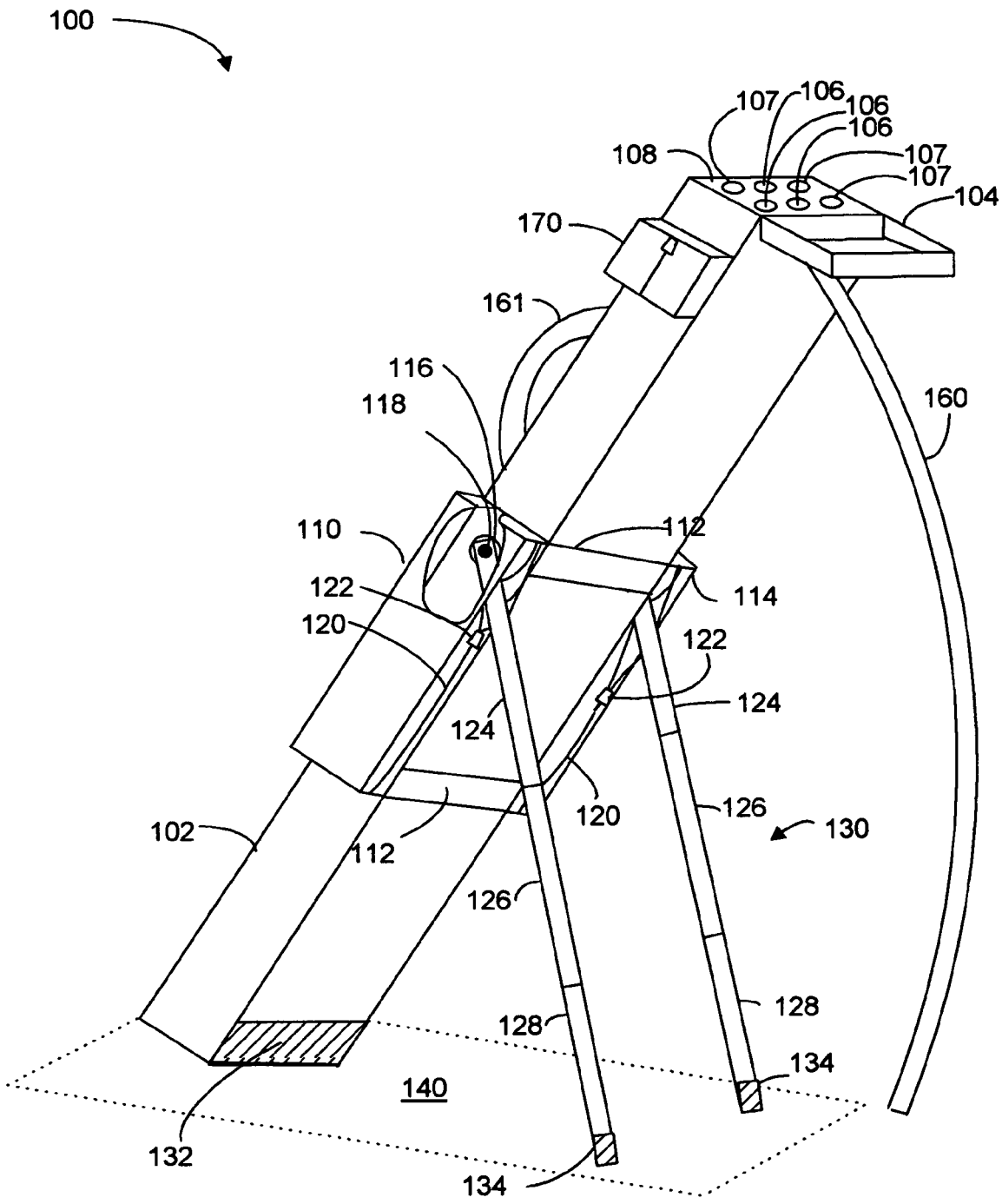
FIG. 1 is a perspective view illustrating a first exemplary embodiment of the pool cue case system according to the present invention.

FIG. 1 is a perspective view illustrating a first exemplary embodiment of the pool cue case system 100 according to the present invention. Pool cue case 102 is illustrated as a generally rectangular cylindrical tube containing a core material 108, which has a plurality of pool cue shaft bores 107 and pool cue handle bores 106 for receiving portions of a pool cue stick. Pool cue case 102 has a lid 104 for covering the ends of pool cue shafts and handles during storage and transport. Releasably coupled to the exterior of the case 102 are re-closable enclosures 110 and 114 from which supports 130 extend to support the case in a nearly vertical position. The re-closable enclosures 110 and 114 are preferably made of leather at least ⅛-inch thick or other semi-rigid material capable of protecting the supports 130 from damage when stowed for transport within re-closable enclosures 110 and 114. Each re-closable enclosure 110 and 114 has a closure 120 and a closure actuator 122. The closure is preferably a continuous closure, such as a zipper, a zip-lock, or a hook and loop fastener. Those skilled in the art, upon reading the teachings of this specification, will appreciate that, under appropriate circumstances, considering such issues as user preferences, ergonomic factors, and cost, other types of closures, such as snaps, buttons, and the like, may suffice.

Re-closable enclosures 110 and 114 are coupled to the pool cue case by releasable couplings 112. The releasable couplings 112, illustrated as straps, are preferably integral to the re-closable enclosures 110 and 114. In some embodiments, the releasable couplings 112 may be separable from the re-closable enclosures 110 and 114. For example, the re-closable enclosures 110 and 114 may have adaptations, such as slots, for receiving releasable couplings 112, such as straps. For the exemplary embodiment using straps for releasable couplings 112, the straps may be fastened by any means known in the art, including hook and loop fasteners, buckles, snaps, and the like. Preferably, the re-closable enclosures 110 and 114 are adjustable to various positions on the pool cue case 102. Preferably, the supports 130 are positionable, when deployed, to provide no increase in the footprint 140 of the pool cue case 102 and any attached enclosures, such as re-closable enclosures 110 and 114.

In a preferred embodiment, additional enclosures 170 for chalk, shooting bridges, and other paraphernalia are also coupled to the exterior of case 102. Likewise, in a preferred embodiment, a carrying handle 161 and a shoulder strap 160 (shown partially connected for clarity of the drawing: the disconnected end attaches near the foot 132), are also coupled to the outside of the pool cue case 102. Those skilled in the art, upon reading the teachings of this specification, will appreciate that, under appropriate circumstances, considering such issues as market forces, user preferences, and portability, other releasable couplings 112, such as snaps, clamps, locks, etc., may suffice.

In another preferred embodiment, re-closable enclosures 110 and 114 are sized for the dual role of stowing the supports 130 and carrying the chalk, shooting bridges, and other paraphernalia. Those skilled in the art, upon reading the teachings of this specification, will appreciate that, under appropriate circumstances, considering such issues as market forces, user preferences, and ergonomics, other shapes, sizes, and numbers of re-closable enclosures 110 and 114, adapted to a particular case shape, handle 161 position, carrying strap 160 position, and the positions and sizes of other enclosures 170 coupled to the exterior of pool cue case 102, etc., may suffice.

Supports 130 may be of any substantially rigid material and are preferably comprised of a lightweight material such as aluminum, boron-epoxy composite, titanium, plastic, and the like. Supports 130 are preferably extendable legs, each comprised of segments 124, 126, and 128, which are preferably extendable by telescoping. The segments 124, 126, and 128 are preferably sized to fit within the re-closable enclosure 110 or 114 for stowage during transport and storage. In a preferred embodiment, the supports 130 are extendable legs that are preferably spring-biased with a release mechanism that can be actuated to extend the supports 130. In another preferred embodiment, a closed re-closable enclosure 110 or 114 constrains a spring bias in the telescoping extendable leg supports 130 such that each of the supports 130 extend automatically when its respective re-closable enclosure 110 or 114 is opened. Other types of supports 130, such as folding legs (including folding tent-pole-type legs with internal elastic cord connecting the segments 124, 126, and 128), discrete connectable segments, scissor-action legs, and articulated legs with locks are preferred in various other preferred embodiments. Those skilled in the art, upon reading the teachings of this specification, will appreciate that, under appropriate circumstances, considering such issues as market forces, user preferences, and material properties, other supports, such as pedestals, tripods, and legs of various decorative or adaptive shapes, may suffice.

Each support 130 is preferably flexibly coupled to the re-closable enclosure 110 or 114. The flexible support coupling 118 is configured to enable deployment of supports 130 in a tripod configuration with the pool cue case 102 forming one tripod leg, as shown. The support coupling 118 may include spring bias toward the extended, or deployed, position or toward preferential positioning, such as by a détente in coupling base 116. Other flexible support couplings 116 between the support and the re-closable enclosure 110 are also preferred in various preferred embodiments and may include any type of support coupling 116 as known in the art. For example, the art of extendable card table supports and the art of extendable golf-bag supports provides numerous approaches to flexible support couplings for supports 130 and for deploying the supports 130 to a preferred position. The support coupling 118 is preferably coupled directly to the re-closable enclosure 110 and at least part of the support coupling 118 is preferably permanently coupled to the re-closable enclosure 110. Those skilled in the art, upon reading the teachings of this specification, will appreciate that, under appropriate circumstances, considering such issues as market forces, user preferences, and material properties, other support couplings 118, such as two-axis couplings, universal couplings, and couplings integral with supports 130, etc., may suffice.

In yet another preferred embodiment, each support 130 is preferably flexibly coupled to the re-closable enclosure 110 or 114 and to the exterior of pool cue case 102 and covered by at least a portion of re-closable enclosure 110 or 114. While it is preferred to couple the support coupling 118 to an interior portion of the re-closable enclosure 110 or 114 adjacent the pool cue case 102, it will be appreciated that the support coupling 118 may be coupled to any portion of the re-closable enclosure 110 or 114.

Supports 130 preferably have high-friction feet 134 to reduce slippage. High-friction feet 134 maybe made of any suitable material, such as rubber, neoprene, and the like. High-friction feet 134 are preferably integral with segment 128. In another embodiment, high-friction feet 134 are preferably removable and stowable in re-closable enclosure 110 and/or 114 in an alternate preferred embodiment. Pool cue case 102 preferably has a high-friction foot 132 to reduce slippage. The high-friction foot 132 is preferably integral to pool cue case 102. In an alternate preferred embodiment, high-friction foot 132 is preferably removable and stowable in re-closable enclosure 110 or 114. Those skilled in the art, upon reading the teachings of this specification, will appreciate that, under appropriate circumstances, considering such issues as market forces, user preferences, and material properties, other high-friction feet 134 and high-friction foot 132, such as ribbed feet, swivel-mounted feet, angled feet, etc., may suffice.

Figure 2:
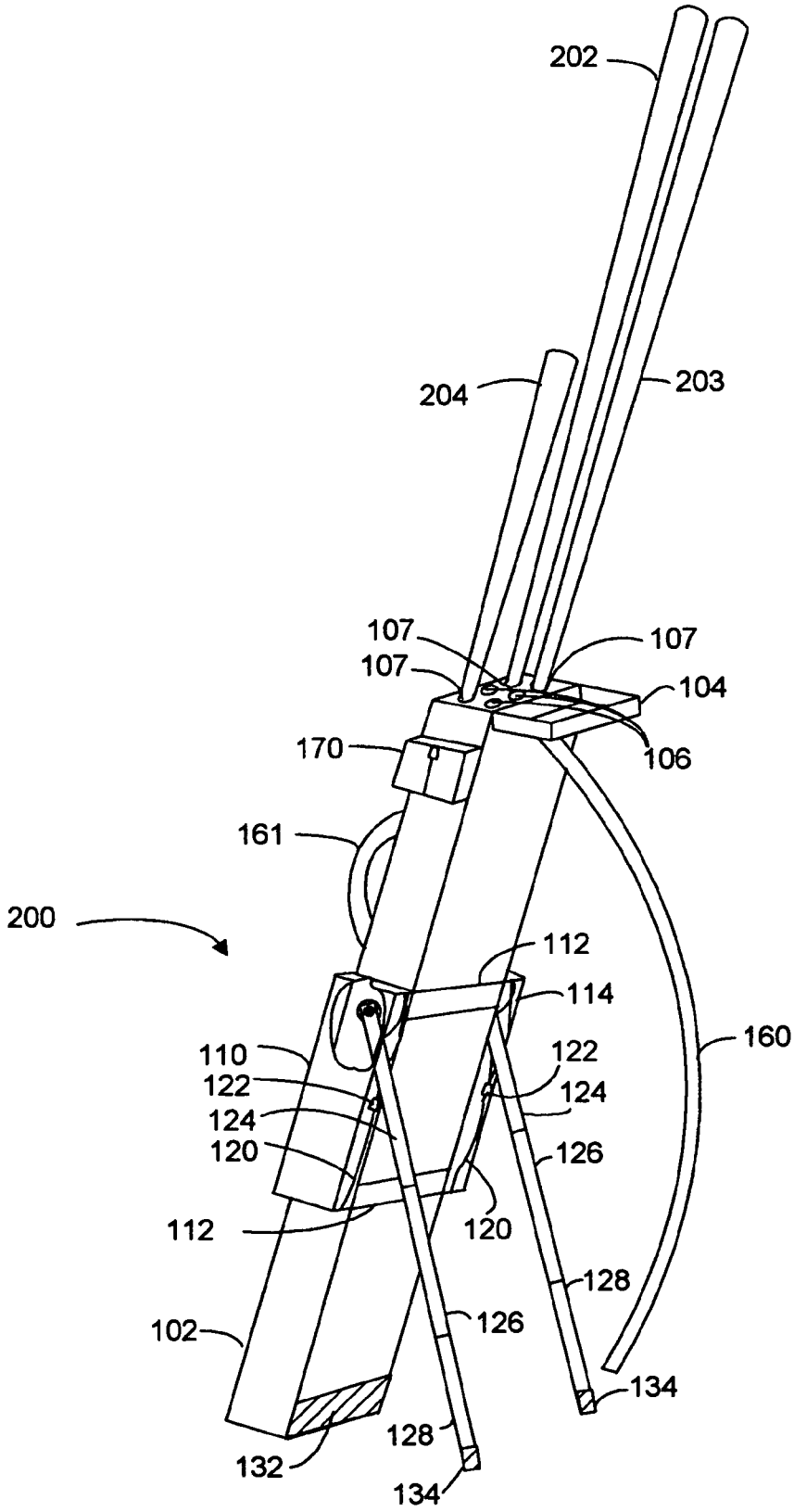
FIG. 2 is a perspective view illustrating an exemplary embodiment of a pool cue case of FIG. 1 in use as a stand for a plurality of assembled pool cues.

FIG. 2 is a perspective view illustrating an exemplary embodiment 200 of a pool cue case system 100 of FIG. 1 in use as a stand for assembled shooter cue 202, assembled break cue 230, and assembled jump cue 204. Pool cues 202-204 are illustrated in assembled configurations with the shaft ends of the pool cues 202-204 inserted into pool cue shaft bores 107. The pool cues 202-204 are readily available for use while taking up little floor space. Further, the pool cues 202-204 are relatively safe from being knocked over, impacted by furniture or clumsy persons, or otherwise damaged. Preferably, embodiment 200 will also have a carrying handle 161 and a shoulder strap 160 (shown partially connected for clarity of the drawing: the disconnected end attaches near the foot 132), as well as additional enclosures 170 coupled to the exterior of pool cue case 102. By keeping the cues 202-204 nearly vertical (preferably 60-89 angular degrees measured up from the floor), bending forces on the pool cues 202-204 are reduced, thereby reducing the likelihood of warping. Those skilled in the art, upon reading the teachings of this specification, will appreciate that, under appropriate circumstances, considering such issues as market forces, user preferences, and pool cue case 102 designs, other bores 107, such as a deeper, wider bore 107 to receive a longer portion of assembled pool cue 202-204, an extra bore specifically adapted to hold more than half of an assembled pool cue 202-204, closable openings in the lid 104 aligned to the bores 107, etc., may suffice.

Figure 3:
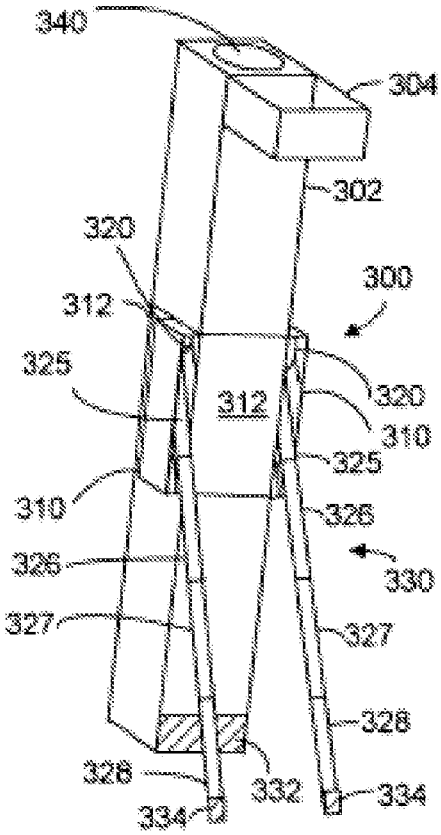
FIG. 3 is a perspective view illustrating a second exemplary embodiment of the pool cue case system according to the present invention.

FIG. 3 is a perspective view illustrating a second exemplary embodiment of the pool cue case system 300 according to the present invention. Re-closable enclosures 310 are sized to receive little more than the extendable, segmented supports 330 for stowage. Segments 325, 326, 327, and 328 may be any type of extendable leg segments and are preferably telescoping and more preferably spring-biased telescoping segments. Releasable coupling 312, between the re-closable enclosures 310, and the pool cue case 302 is illustrated as a single, broad strap but may be any type of coupling that will releasably couple the re-closable enclosures 310 to the pool cue case 302. Bore 340 is a single large case interior space for holding a plurality of items together or individually wrapped or encased in removable covers. Closures 320 may be of any type, but are preferably zippers. Lid 304 is optional. In an alternate embodiment, case 302 may be sized for golf clubs and feet 332, 334 may be adapted for non-floor surfaces, such as turf. Those skilled in the art, upon reading the teachings of this specification, will appreciate that, under appropriate circumstances, considering such issues as market forces, user preferences, and intended use, other enclosable supports 330 adapted to other case designs, such as suit cases, traveling display cases, camera cases, etc., may suffice.

Figure 4:
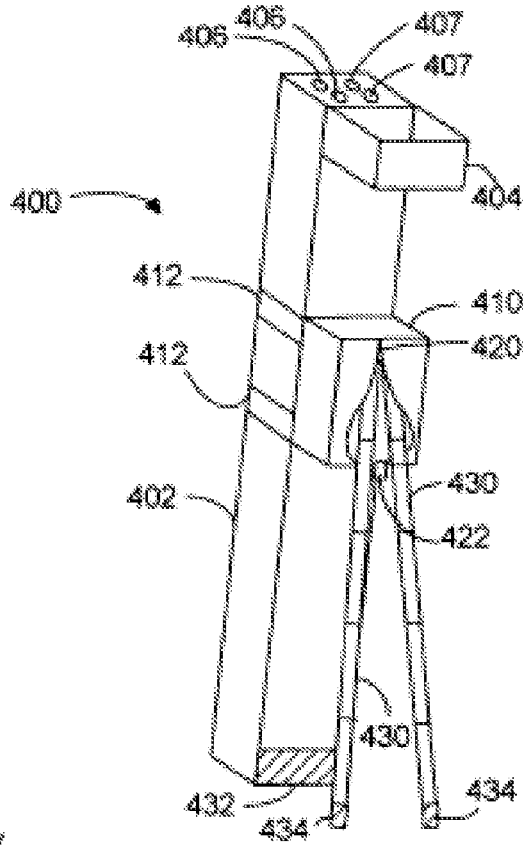
FIG. 4 is a perspective view illustrating a third exemplary embodiment of the exemplary pool cue case system according to the present invention.

FIG. 4 is a perspective view illustrating a third exemplary embodiment of the exemplary pool cue case system 400 according to the present invention. Pool case system 400 has a single re-closable enclosure 410 adjustably and releasably coupled to pool cue case 402 via releasable coupling 412, illustrated as two straps. Frontal closure 420 is preferably a zipper, operable with closure mechanism 422, preferably a zipper pull. Other types of closures 320, as mentioned above relating to FIG. 1, are also preferred in alternate preferred embodiments. Extendable, or deployable, segmented supports 430 are preferably coupled to the rear interior surface of re-closable enclosure 410. Pool cue shaft bores 407 and pool cue handle bores 406 are preferably arranged pair-wise, but may be in any configuration in other embodiments. Lid 404 preferably has a semi-circumferential closure, such as a zipper, for securing the lid 404 to pool cue case 402. Feet 432, 434 are preferably configured to reduce slippage on smooth surfaces and on carpeted floors. Those skilled in the art, upon reading the teachings of this specification, will appreciate that, under appropriate circumstances, considering such issues as market forces, user preferences, and intended use, other re-closable enclosures 410, such as re-closable enclosures having closures 420 of various types, locations, orientations and configurations, etc., may suffice.

Figure 5:
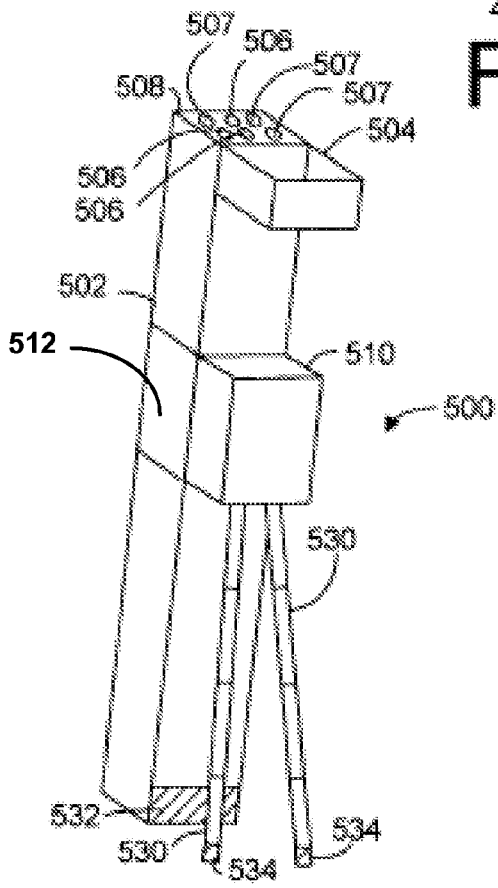
FIG. 5 is a perspective view illustrating a fourth exemplary embodiment of the exemplary pool cue case system according to the present invention.

FIG. 5 is a perspective view illustrating a fourth exemplary embodiment of the exemplary pool cue case system 500 according to the present invention. Pool cue system 500 is preferably a single, bottom-opening re-closable enclosure 510 adjustably and releasably coupled to pool cue case 502 with releasable coupling 512, which is illustrated as a single broad strap. Re-closable enclosure 510 is preferably sufficiently rigid to protect the legs 530, when stowed therein, from the hazards of transport and luggage handling. In an alternate embodiment, re-closable enclosure 510 is preferably rigid and has a hinged door with a latch for a closure 510. Extendable, or deployable, segmented supports 530 are preferably coupled to the rear interior surface of re-closable enclosure 410 but may be coupled at any point at least partially interior to re-closable enclosure 410. Feet 534 and 532 are preferably adapted for high friction in contact with floors. Cue shaft bores 507 and cue handle bores 506 are arranged in core 508 to provide stability and balance when the case is used as a pool cue stand. Lid 502 is shown in the open position and is preferably semi-rigid and more preferably rigid with interior padding to protect the ends of pool cue shafts and handles during transport. Those skilled in the art, upon reading the teachings of this specification, will appreciate that, under appropriate circumstances, considering such issues as market forces, user preferences, and intended use, other approaches for improving balance and stability, such as weighting the bottom of the pool cue case 502, angling the pool cue shaft bores 507 to hold cues veertically when the case 502 is supported in an inclined position, etc., may suffice.

In another alternate embodiment, the bottom of the re-closable enclosure 510 preferably uses feet 534 as the closures of adaptively shaped and sized openings in the bottom portion of re-closable enclosure 510. In this alternate embodiment, the supports 530 are preferably rigidly coupled to the interior of the re-closable enclosure 510 and are preferably spring-biased telescoping legs which telescope into and out of the adaptively shaped and sized openings, or holes, such that, in the stowed position, the feet 534 close the holes. The rigid coupling is preferably angled to direct the supports 530 into a desired tripod configuration with the case 502 as one leg.

Figure 6:
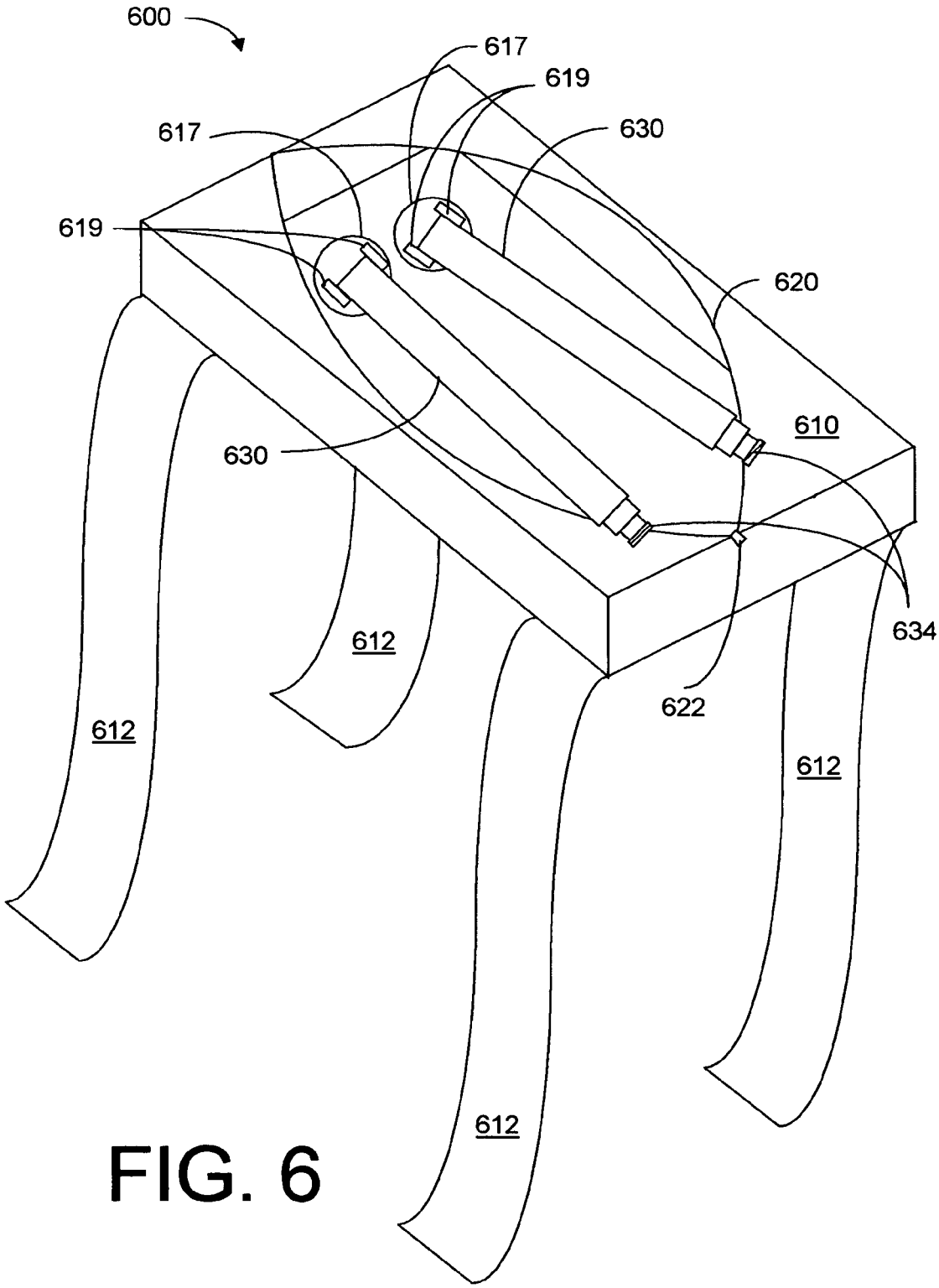
FIG. 6 is a perspective view illustrating a fifth exemplary embodiment of the exemplary pool cue case system according to the present invention.

FIG. 6 is a perspective view illustrating a fifth exemplary embodiment of the exemplary pool cue case system 600 according to the present invention. Re-closable enclosure 610 is shown with closure 620, illustrated as a zipper with pull-tab 622, in an open position with supports 630 partially deployed through closure 620. Couplings 617 provide rotation about a first axis and brackets 619 hold an axle for rotation about a second axis. Feet 634 are preferably adapted to frictionally engage a surface when in use. Releasable couplings 612, illustrated as straps, are preferably integral to re-closable enclosure 610 but may, in some alternate embodiments be releasable from the re-closable enclosure 610. Re-closable enclosure 610 is preferably sufficiently rigid to provide protection for the supports 630 during transport and luggage handling. Supports 630 are illustrated as telescoping legs, which may be locked in various telescoped positions by means known in the art of telescoping tripod legs. It will be understood that re-closable enclosure 610 is preferably sized and shaped adaptive to various cases and applications, and that the invention is not limited to re-closable enclosures 610 of a particular shape and size. Those skilled in the art, upon reading the teachings of this specification, will appreciate that, under appropriate circumstances, considering such issues as market forces, user preferences, and intended use, other releasable couplings 612, such as snaps, clamps, hook and loop fasteners, etc., may suffice.

Figure 7:
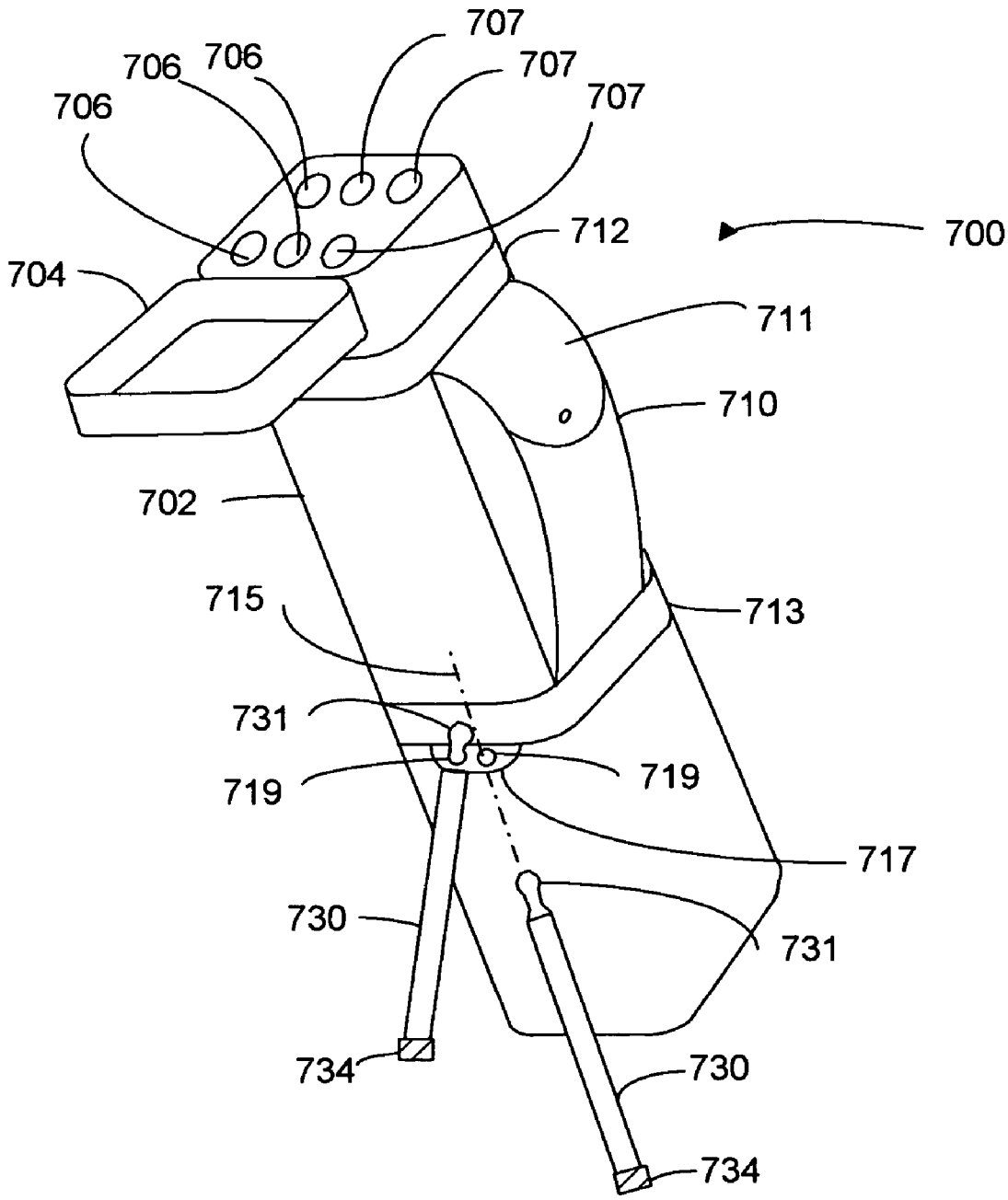
FIG. 7 is a perspective view illustrating a sixth exemplary embodiment of the exemplary pool case cue system according to the present invention.

FIG. 7 is a perspective view illustrating a sixth exemplary embodiment of the exemplary pool cue case system 700 according to the present invention. Lid 704 preferably has a semi-circumferential closure, such as a zipper, for securing the lid 704 to pool cue case 702. Re-closable enclosure 710 is preferably coupled to pool cue case 702 using releasable couplings 712 and 713, illustrated as straps. Coupling 713 is preferably a strap of resilient material such as thick leather or the tough material used to make mud flaps for trucks. Coupling 713 has a flange 717 having two bores 719 there through. Supports 730 with feet 734 are preferably stowable in re-closable enclosure 710. Each support 730 preferably has a pin 731 in the end of support 730 opposite the end having foot 734. Each pin 73 1 is shaped and sized to be inserted and held in a bore 719, illustrated as insertion along line 715. The force exerted by the resiliency of the material holds the supports 730 in position. In alternate embodiments, flange 717 is preferably placed variously on the upper coupling 712, on the re-closable enclosure 710, or in the re-closable enclosure 710. For example, flange 717 may be integral to closure 711, illustrated as a flap to re-closable enclosure 710. Pool cue shaft bores 707 and pool cue handle bores 706 are preferably arranged pair-wise, but may be in any configuration in other embodiments. Those skilled in the art, upon reading the teachings of this specification, will appreciate that, under appropriate circumstances, considering such issues as market forces, user preferences, and intended use, other approaches to making coupling 713, such as angled bores 719, bores in flap 711, additional mechanical constraints to maintain preferred positions of supports 730, and supports 730 of various designs, etc., may suffice.

Figure 8:
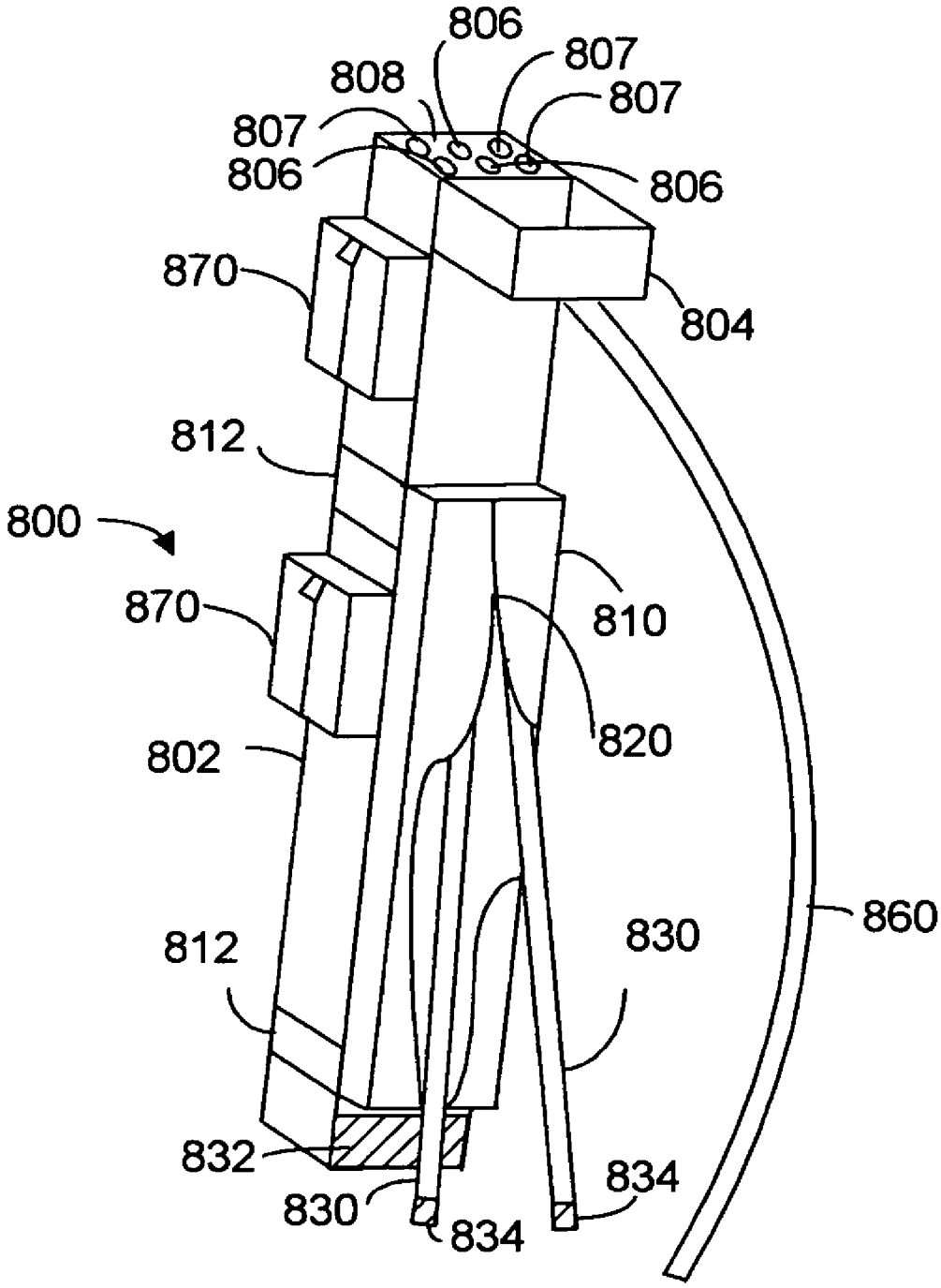
FIG. 8 is a perspective view illustrating a seventh exemplary embodiment of the exemplary pool case cue system according to the present invention.

FIG. 8 is a perspective view illustrating a seventh exemplary embodiment of the exemplary pool cue case system 800 according to the present invention. Re-closable enclosure 810 is adjustably and releasably coupled to pool cue case using releasable couplings 812, which are illustrated as straps. Closure 820 is shown in the open position with non-segmented supports 830 deployed there through. Feet 832 and 834 are preferably adapted to reduce slippage on floors. Pool cue shaft bores 807 and pool cue handle bores 806 in core 808 are preferably adapted to particular cue types, where appropriate. This embodiment illustrates that the supports 830 need not be extendable. Lid 804,shown in the fully open position, is operable to be fastened over the top end of case 802. Zippered pouches 870 may be attached to any surface of the case 802, but are shown on the side for clarity of the drawing. Shoulder strap 860 is shown disconnected at one end for clarity in the drawing: the disconnected end is normally attached near the foot 832. It is preferable to have the foot 832, the lid 804, the re-closable enclosure 810, and the shoulder strap on the same side of the case 802. Those skilled in the art, upon reading the teachings of this specification, will appreciate that, under appropriate circumstances, considering such issues as market forces, user preferences, and intended use, other arrangements of the shoulder strap 860, the re-closable enclosure 810, the zippered pouches 870, such as placing some of the items on various sides of case 902, adding a carrying handle, etc., may suffice.

Figure 9A:
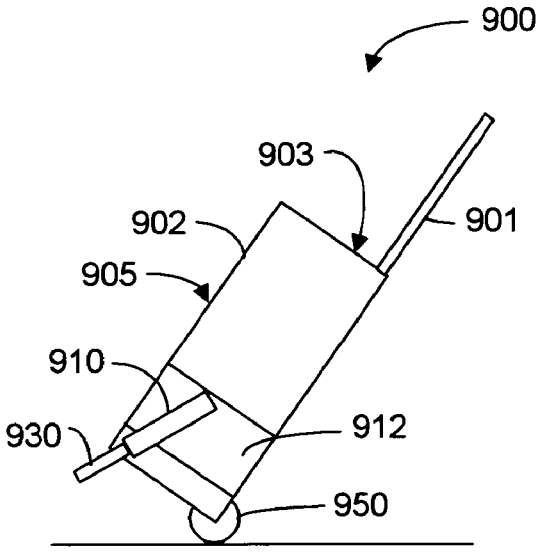
FIG. 9 is a perspective view illustrating an eighth exemplary embodiment of the exemplary pool cue case system according to the present invention.
Figure 9B:
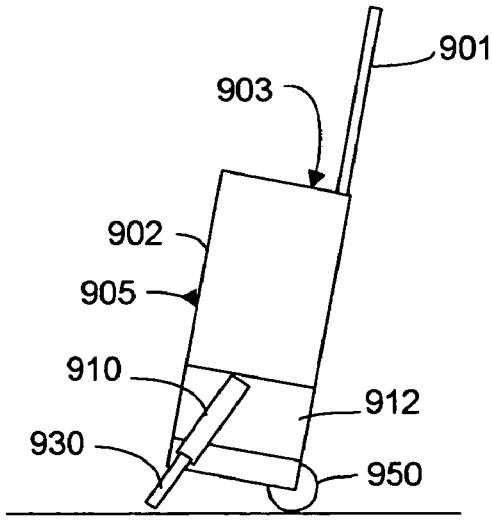

FIGS. 9A and 9B are side views illustrating an eighth exemplary embodiment of the exemplary pool cue case system 900 according to the present invention. FIG.9A shows the case 902 in a position to be pulled by a person via handle 901. FIG. 9B shows the case 902 in an upright position, supported by support 930. Re-closable enclosure 910 is preferably coupled to case 902, with coupling 912, shown as a strap, in a position to extend support 930 to support case 902 in the generally upright position. Carry-on luggage, for example, is often unstable in an upright position because people piggy-back other luggage on top surface 903, making unstable a case 902 that was originally designed to be stable. One popular technique is to piggy-back a laptop computer case or other additional luggage on surface 905, creating a torque about wheel 950 which tends to tip the luggage over backwards. In this configuration, the handle 901 transmits an upward force on the hand of the person pulling the case 902. As a result, the person pulling the case 902 does not have to lift any weight when pulling on level ground. This makes pulling the case 902 a great deal easier, but then the case 902 falls over when parked. By adding the enclosable and deployable support 930 to the case 902, a case 902 used in piggy-back mode can be made to stand nearly upright when parked. Those skilled in the art, upon reading the teachings of this specification, will appreciate that, under appropriate circumstances, considering such issues as market forces, user preferences, and intended use, other arrangements of the re-closable enclosure 910, such as placing the re-closable enclosure 910 on surface 905, having two re-closable enclosures 910, etc., may suffice.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A case support system for supporting a case in a stationary position, such case adapted to releasably encase at least one article, said case support system further comprising:

at least one re-closable enclosure operable to be releasably coupled to the exterior of such case;

at least one support for such case, wherein said at least one support is internally stowable within said at least one re-closable enclosure; and at least one support coupling coupled to said at least one re-closable enclosure, wherein said at least one internally stowable support is operable to be coupled to said at least one support coupling and operable to be at least partially deployed external to said at least one re-closable enclosure to support such case.

2. The case support system of claim 1, wherein said at least one support coupling is coupled to an interior surface of said at least one re-closable enclosure.

3. The case support system of claim 1, further comprising a foot coupled to such case, wherein said foot is positioned to frictionally engage a generally horizontal surface.

4. The case support system of claim 1, wherein said at least one re-closable enclosure comprises at least one releasable coupling adapted for releasably coupling said at least one re-closable enclosure to such case.

5. The case support system of claim 1, wherein said at least one internally stowable support, when at least partially deployed, is positioned and oriented as to not increase the footprint of such case on a generally horizontal surface.

6. The case support system of claim 1, wherein said at least one internally disposed support comprises at least one extendable leg.

7. The case support system of claim 1, wherein said re-closable enclosure comprises a pouch having a closure comprising a zipper.

8. The case support system of claim 1, wherein said at least one support coupling is operable to maintain said at least one support in at least one fixed position.

9. A case support system for supporting a case in a stationary position, said case support system comprising a re-closable enclosure at least one support coupling coupled to at least one portion of said re-closable enclosure;

at least one support having a proximal end operable to be coupled to said at least one support coupling and a distal end at least partially deployable outside said re-closable enclosure; and at least one adaptation for enabling coupling of said re-closable enclosure to such case.

10. The case support system of claim 9, wherein said at least one support coupling comprises at least one support coupling coupled to an interior portion of said re-closable enclosure.

11. The case support system of claim 9, wherein said at least one support comprises at least one extendable leg.

12. The case support system of claim 9, wherein said at least one adaptation for enabling coupling of said re-closable enclosure with such case comprises at least one adaptation for coupling of said re-closable enclosure to at least one surface of one such case.

13. A case support system for supporting, in a stationary position, a pool cue case adapted to encase disconnected sections of at least one pool cue, said case support system further comprising:

at least one pool cue case reconfigurer operable to enable such pool cue case to support, in an inclined position, assembled such disconnected sections of the at least one pool cue; and at least one re-closable enclosure, operable to be releasably coupled to an exterior surface of such pool cue case and operable to enclose at least part of said pool cue case reconfigurer when said pool cue case reconfigurer is in a stowed position.

14. The case support system of claim 13, wherein said at least one pool cue case reconfigurer comprises:

at least one support coupling coupled to said re-closable enclosure; and at least one support having a proximal end operable to be coupled to said at least one support coupling and having a distal end at least partially deployable outside said at least one re-closable enclosure when said at least one re-closable enclosure is open.

15. The case support system of claim 14, wherein said at least one support coupling is coupled to an interior portion of said re-closable enclosure.

16. The case support system of claim 14, wherein said at least one support coupling is operable to maintain said at least one support in at least one fixed position.

17. The case support system of claim 14, wherein said at least one support coupling comprises:

at least one resilient material; and at least one bore in a portion of said resilient material, wherein said at least one bore is sized and oriented to couplingly receive said at least one support.

18. The case support system of claim 14, wherein said at least one support, when at least partially deployed, is positioned and oriented as to not increase the footprint of such case on a generally horizontal surface.

19. The case support system of claim 14, wherein said at least one support comprises at least one extendable leg.

20. The case support system of claim 13, wherein said re-closable enclosure comprises a pouch having a closure comprising a zipper.

* * * * *